US006145412A

United States Patent [19]

Cheng et al.

[11] Patent Number: 6,145,412

[45] Date of Patent: Nov. 14, 2000

[54] RATCHET TOOL

[76] Inventors: Shiu-Mei Cheng, F. 4,No.51, Lane 284, Wu-Shing St, Taipei City; Jung-Sheng Huang, F.1, No.27, Lane 35, Chia-Ho Rd, Ta-Chia Chen, Taichung Hsien; Yi-Ming Tung, No.23, Tsu-Chiang 2nd St, Wuchi Town, Taichung, all of Taiwan

[21] Appl. No.: 09/339,219

[22] Filed: Jun. 24, 1999

[51] Int. Cl.[7] ..... B25B 17/00

[52] U.S. Cl. ..... 81/57.29; 81/63

[58] Field of Search ..... 81/57.29, 63, 62, 81/57.13

[56] References Cited

U.S. PATENT DOCUMENTS

| | | | |
|---|---|---|---|
| 4,137,801 | 2/1979 | Imperio | 81/58.1 |
| 4,265,148 | 5/1981 | Gartzke | 81/57.29 |
| 4,406,183 | 9/1983 | Wix | 81/57.29 |
| 4,532,832 | 8/1985 | Christensen | 81/57.29 |
| 4,545,267 | 10/1985 | Shumway | 81/57.29 |
| 4,869,138 | 9/1989 | Farris | 81/63 |
| 4,907,476 | 3/1990 | Singleton | 81/57.29 |
| 5,058,463 | 10/1991 | Wannop | 81/57.29 |
| 5,471,898 | 12/1995 | Forman | 81/57.29 |
| 5,887,493 | 3/1999 | Main | 81/57.29 |

*Primary Examiner*—James G. Smith
*Assistant Examiner*—Hadi Shakeri
*Attorney, Agent, or Firm*—Rosenberg, Klein & Lee

[57] ABSTRACT

A ratchet tool includes a head and a shank extending from the head in which a ratchet and a pawl are received in the head. A rod is rotatably inserted in the the shank and a grip is connected to the distal end of the shank. The grip is detachably connected to the first end of the rod, and an actuating member is connected to the second end of the rod. The actuating member is engaged with the ratchet which is rotated by the actuating member by rotating the grip. Therefore, the ratchet together with a bit or a socket connected to the ratchet are rotated simply by rotating the grip.

8 Claims, 7 Drawing Sheets

RATCHET TOOL

FIELD OF THE INVENTION

The present invention relates to a ratchet tool which has a micro-adjusting means to rotate the ratchet to output a torque when the handle of the ratchet tool is located in a narrow space.

BACKGROUND OF THE INVENTION

One of the conventional ratchet tools known to applicant is U.S. Pat. No. 4,907,476 to Sidewinder Products Corporation, issued on Mar. 13, 1990. The U.S. Pat. No. 4,907,476 obviously involves a complicated structure and the position handle in this invention elongates the length of the tool and this could be disadvantage for use. Furthermore, the two bevel gears in the head of the tool cannot be disengaged from each other. Therefore, when output a torque, how to fix the other bevel gear will be a potential problem of the socket wrench.

The present invention intends to provide a ratchet tool that can be micro-adjusted to let the ratchet be engaged with the pawl without any gap defined between the ratchet and the pawl so that the torque can be output simply by rotating a grip on the handle of the ratchet tool.

SUMMARY OF THE INVENTION

The present invention provides a ratchet tool comprising a head and a shank extending from the head in which a ratchet and a pawl are rotatably received. The pawl is engaged with the ratchet. The shank has a passage defined therethrough and a rod is rotatably inserted in the passage which communicates with the interior of the head. A grip is connected to the distal end of the shank and detachably connected to the first end of the rod. An actuating member is connected to the second end of the rod and engaged with the ratchet so that the ratchet will be rotated by the actuating member by rotating the grip.

The primary object of the present invention is to provide a ratchet tool which has a rod connected to the ratchet and the rod is rotated by rotating the grip on the shank of the ratchet tool. Therefore, if the space that the handle is located is too small to let the handle be rotated, the ratchet can still be rotated by rotating the grip.

Another object of the present invention is to provide a ratchet tool which has an actuating member engaged with the ratchet and the actuating member is controlled by a grip connected to the shank of the tool so that a gap defined between the ratchet and the pawl can be eliminated by rotating the grip.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
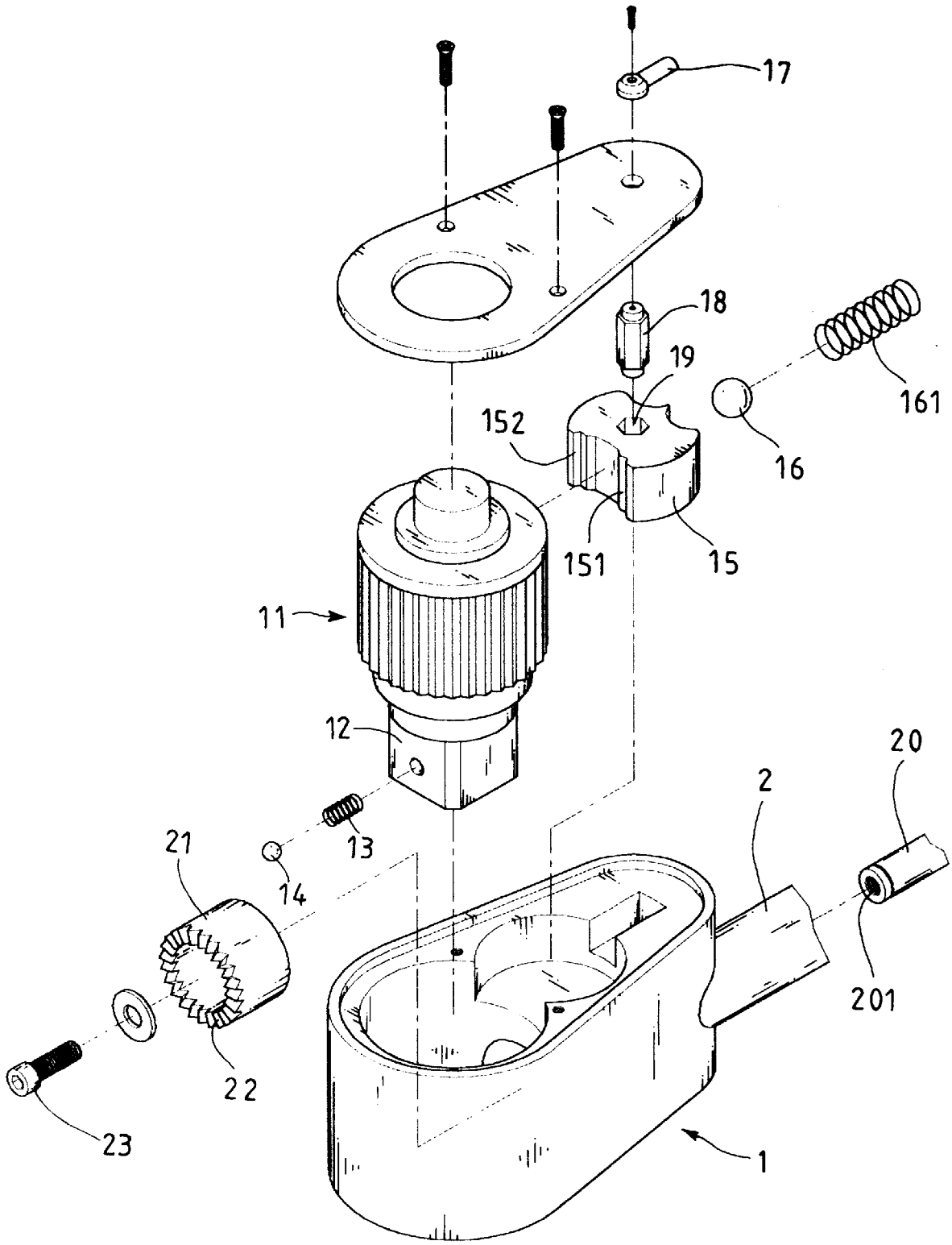
FIG. 1 is an exploded view of the ratchet tool in accordance with the present invention.
Figure 2:
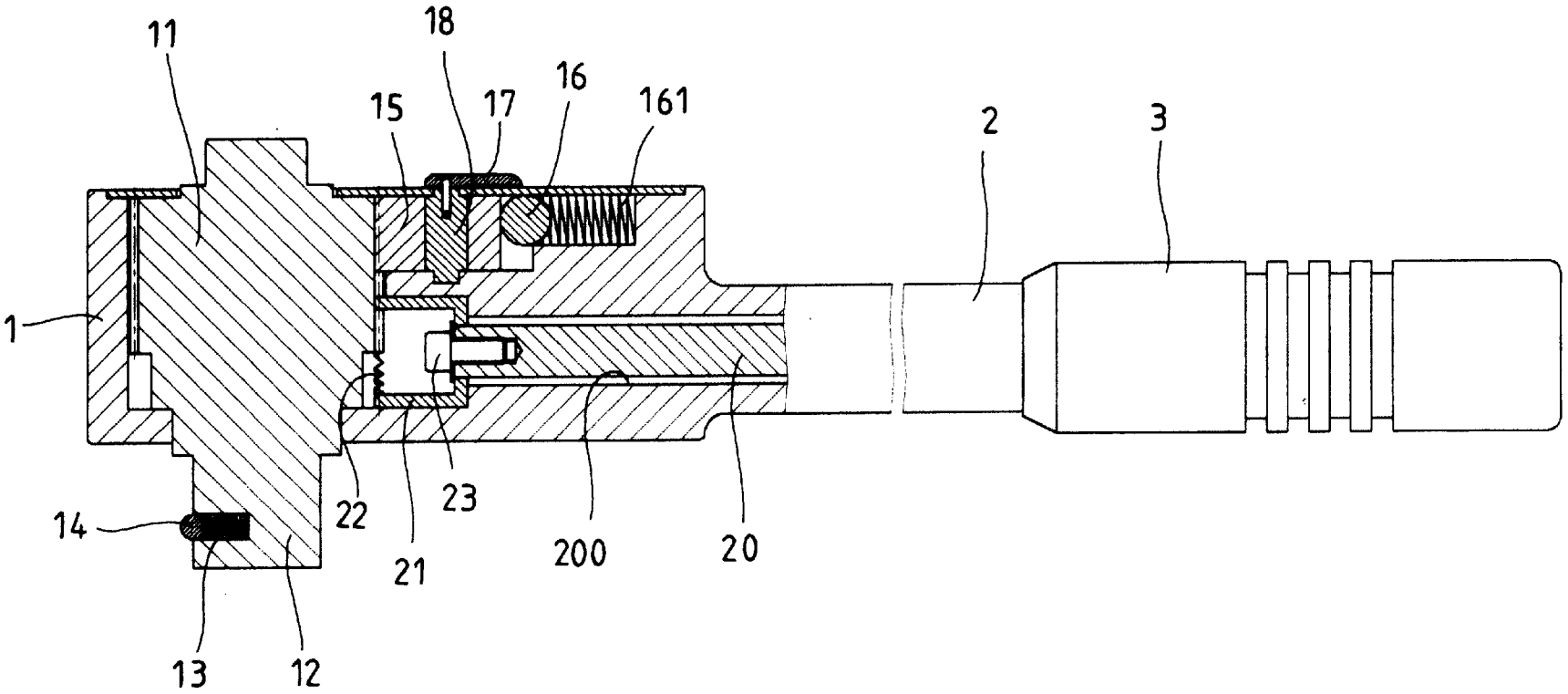
FIG. 2 is a side elevational view, partly in section, of the ratchet tool in accordance with the present invention.
Figure 3:
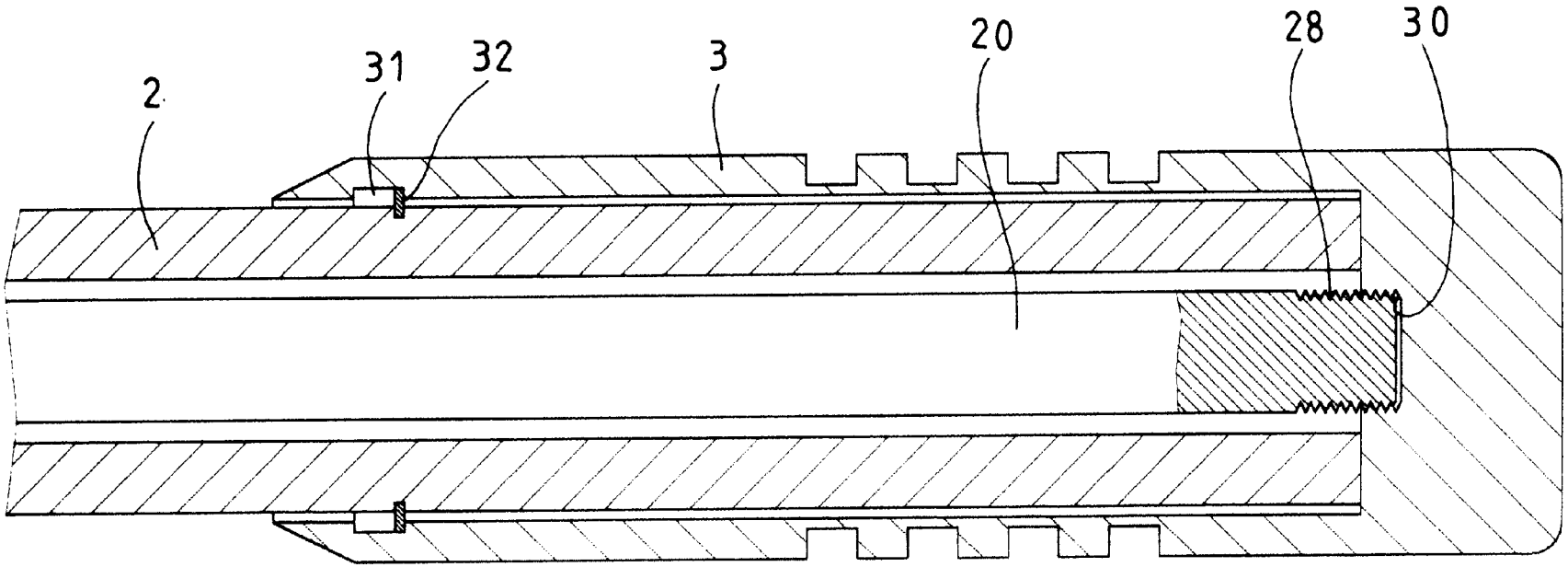
FIG. 3 is a cross-sectional view to show the engagement of the grip and the rod of the ratchet tool, and the release device that allows the grip to be moved relative to the rod in the shank.

Referring to FIGS. 1 to 3, the ratchet tool in accordance with the present invention comprises a head 1 and a shank 2 extending from the head 1, and a grip 3 connected to the shank 2. A ratchet 11 and a pawl 15 are rotatably received in the head 1, wherein the pawl 15 is engaged with the ratchet 11. The ratchet 11 has teeth defined in the outside thereof and an engaging part 12 extends from the lower end of the ratchet 11. A ball 14 and a spring 13 are retained in the engaging part 12 so as to position a socket or an adapter mounted to the engaging part 12. The pawl 15 has two peaks 151, 152 so as to engage with the teeth of the ratchet 11. A shaft 18 is engaged with a hole 19 in the pawl 15 and the shaft 18 is connected to a lever 17 located on the outside of the head 1. When pushing the lever 17, the pawl 15 is rotated and one of the peaks 151, 152 is engaged with the ratchet 11 to limit the effective direction of the ratchet 11. The pawl 15 is positioned by a ball 16 and a spring 161 which are known by the persons skilled in the art.

The shank 2 has a passage 200 defined therethrough and a rod 20 is rotatably inserted in the passage 200 which communicates with the interior of the head 1. The grip 3 is connected to the distal end of the shank 2 and detachably connected to the first end of the rod 20. The first end of the rod 20 has an outer threaded periphery 28 and the grip 3 has a threaded recess 30 defined in an inner end thereof so that the threaded recess 30 is engaged with the outer threaded periphery 28. The grip 3 has an annular groove 31 defined in an inner periphery thereof and the shank 2 has a protrusion 32 which is a C-shaped clip extending radially outward therefrom so that the protrusion 32 is movably retained in the annular groove 31. In other words, the groove 31 and the protrusion 32 are a release device which allows the grip 3 to disengaged from the connection with the first end of the rod 20 by removing the grip 3 away from the rod 20 for a distance the same as the length of the periphery defining the recess 31.

An actuating member 21 is connected to the second end of the rod 20 and engaged with the teeth of the ratchet 11 which is rotated by the actuating member 21. The actuating member 21 is a tubular member and has teeth 22 defined in the distal end thereof so that the teeth 22 are engaged with the ratchet 11. The second end of the rod 20 has an inner threaded periphery 201 and the actuating member 21 is fixedly connected to the second end of the rod 20 by extending a bolt 23 through the actuating member 21 and engaged with the inner threaded periphery 201 in the second end of the rod 20.

Therefore, if the shank 2 is located in a narrow space and the user cannot rotate the shank 2 with a larger angle, the user may rotate the grip 3 to rotate the actuating member 21 to let the ratchet 11 rotate. Therefore, the engaging part 12 is rotated. It is to be noted that, the ratio of the numbers of the teeth of the actuating member 21 and the ratchet 11 can be arranged to function as an effort-saving mode. The actuating member 21 can also be used to eliminate a gap defined between the pawl 15 and the ratchet 11 so that when rotating the shank 2, a torque is output immediately.

Figure 4:
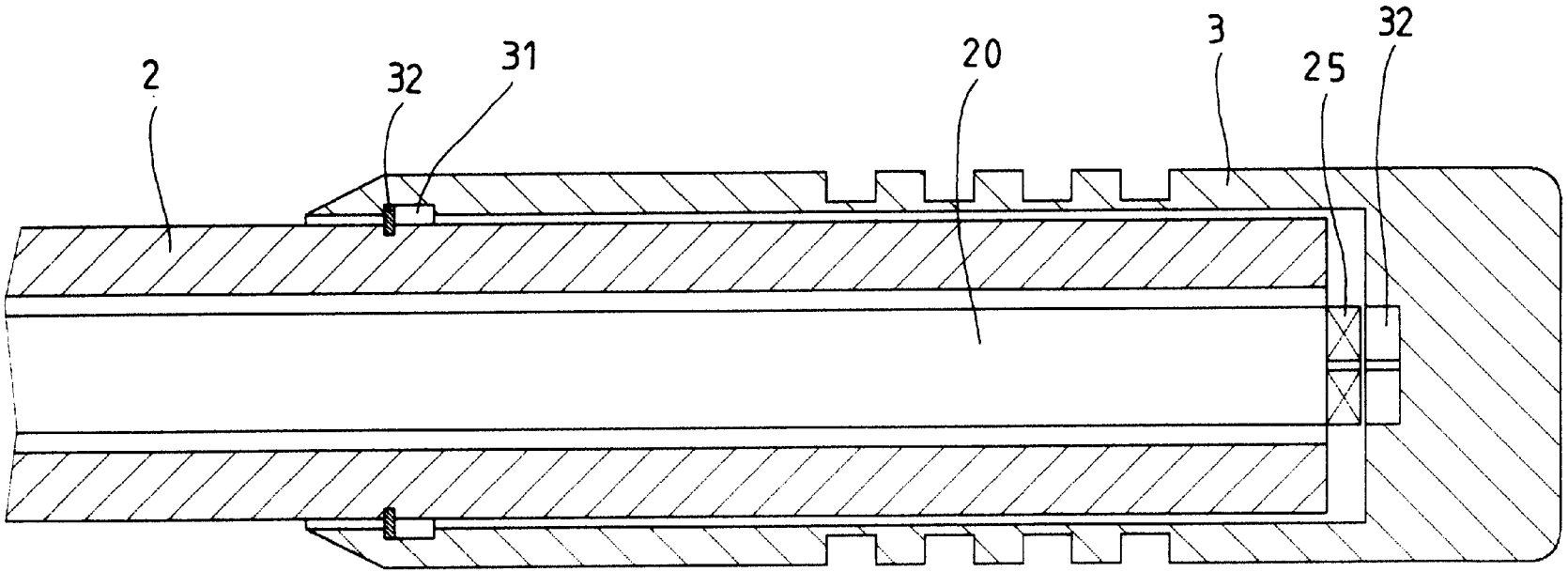
FIG. 4 is a cross-sectional view to show another embodiment of the engagement of the grip and the rod of the ratchet tool.

FIG. 4 shows that the first end of the rod 20 has a polygonal block 25 and the grip 3 has a polygonal recess 32 defined in an inner end thereof so that the polygonal block 25 is detachably received in the polygonal recess 32.

Figure 5:
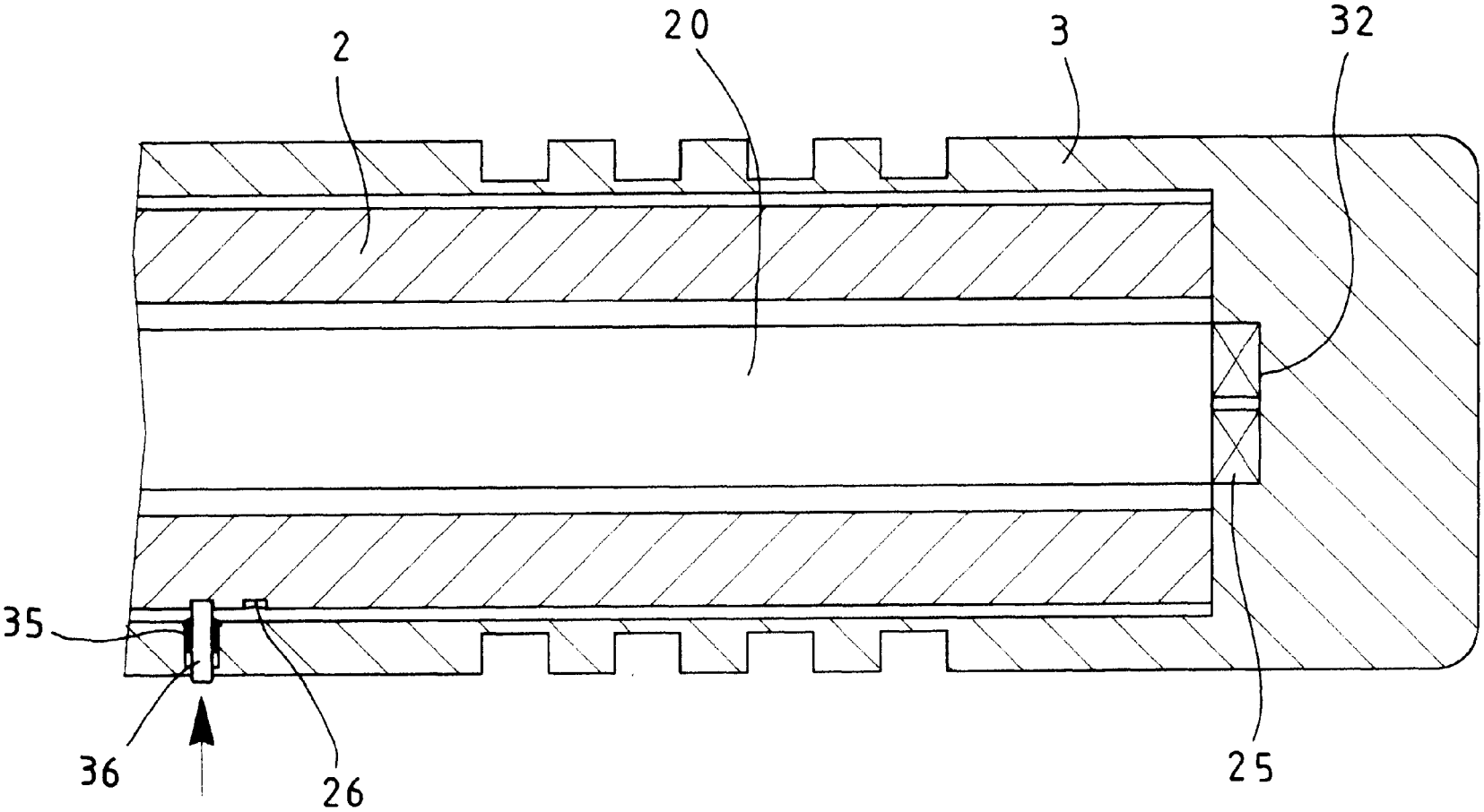
FIG. 5 is a cross-sectional view to show another embodiment of the release device of the grip and the shank.

FIG. 5 shows another embodiment of the release device, wherein the grip 3 has a pin 36 movably extending radially inward from an inner periphery of the grip 3. A spring 35 is mounted to the pin 36 so that the pin 36 is inserted into one of two notches 26 defined in an outer periphery of the shank 2 so as to decide whether the grip 3 is freely disengaged from the block 25 or not.

Figure 6:
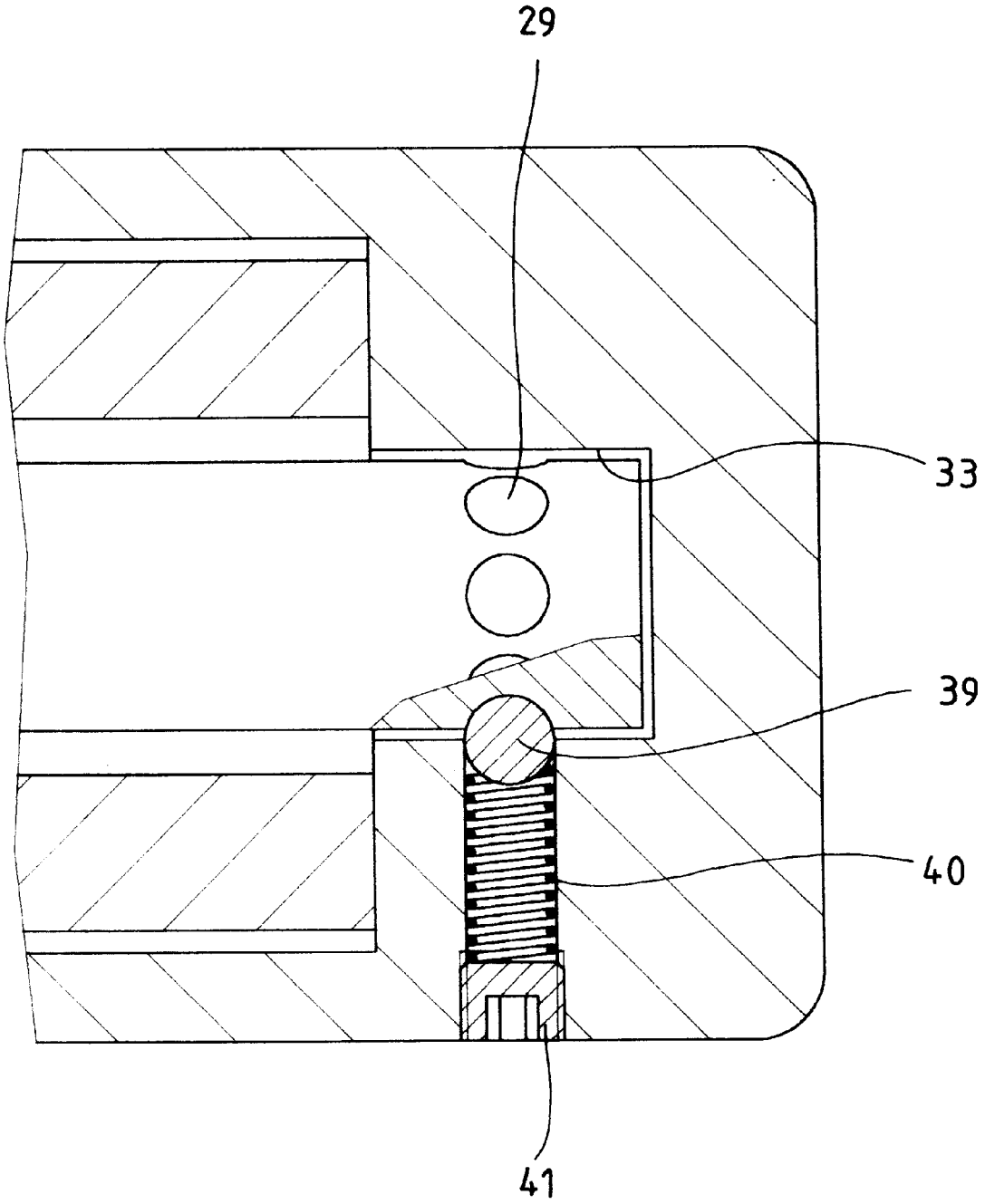
FIG. 6 is a cross-sectional view to show yet another embodiment of the engagement of the rod and the grip.

FIG. 6 shows that the first end of the rod 20 has a tubular portion and a plurality of dents 29 are defined in the periphery of the tubular portion. The grip 3 has a recess 33 defined in an inner end thereof so as to receive the tubular portion of the rod 20. A ball 39 is embedded in the periphery defining the recess 33 and is biased by a spring 40 which is limited by an end cap 41 engaged in the grip 3.

Figure 7:
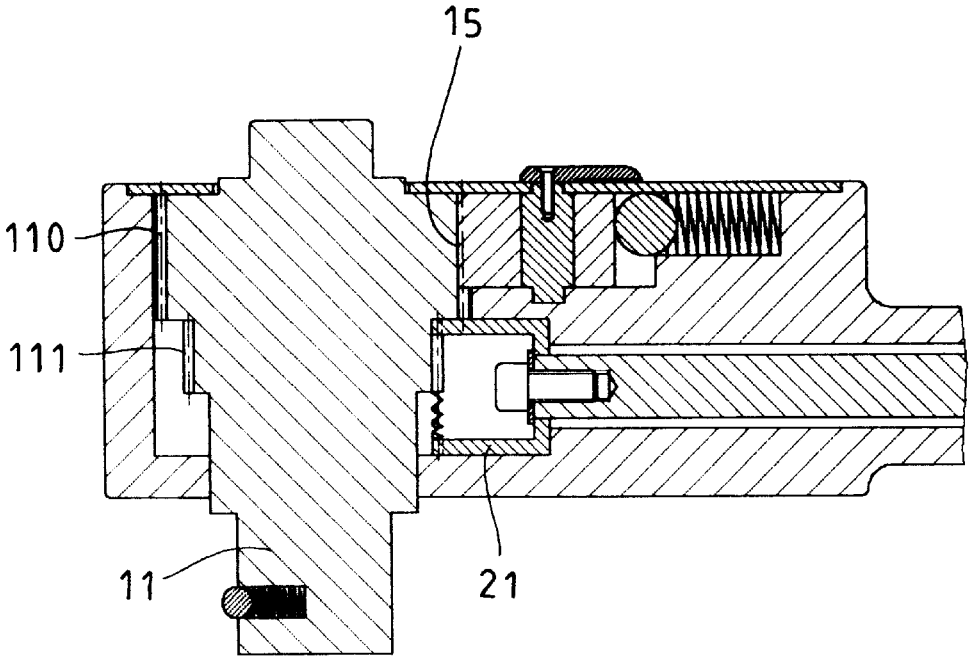
FIG. 7 is a cross-sectional view to show another embodiment of the engagement of the actuating member and the ratchet.
Figure 8:
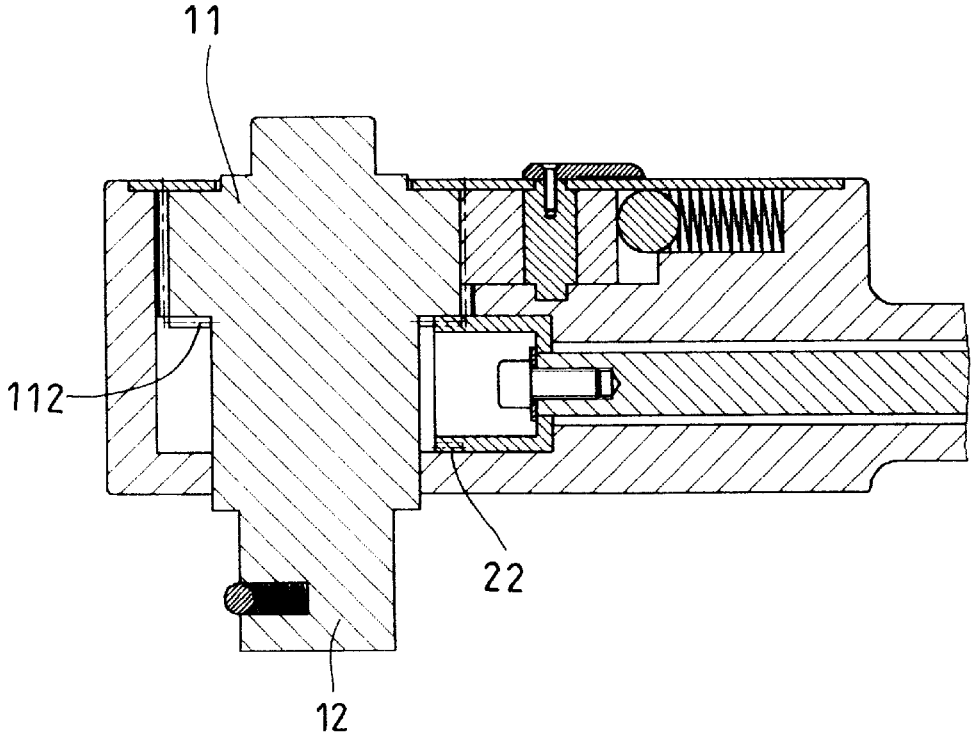
FIG. 8 is a cross-sectional view to show yet another embodiment of the engagement of the actuating member and the ratchet.

FIG. 7 shows that the ratchet 11 has two annular teeth 110 and 111, the teeth 110 is engaged with the pawl 15 and the teeth 111 is engaged with the actuating member. FIG. 8 shows that the ratchet 11 has an annular shoulder which faces toward the engaging part 12 and teeth 112 are defined in the annular shoulder. The actuating member 21 has teeth 22 defined in a periphery thereof and the teeth 22 are engaged with the teeth 112 of the ratchet 11.

While we have shown and described various embodiments in accordance with the present invention, it should be clear to those skilled in the art that further embodiments may be made without departing from the scope and spirit of the present invention.

What is claimed is:

1. A ratchet tool comprising:

a head (1) and a shank (2) extending from said head (1), said shank (2) having a passage defined therethrough and a rod (20) rotatably inserted in said passage, said passage communicating with an interior of said head (1), a grip (3) connected to a distal end of said shank (2) and detachably connected to a first end of said rod (20), said first end of said rod (20) having an outer threaded periphery (28) and said grip (3) having a threaded recess (30) defined in an inner end thereof, said threaded recess (30) engaged with said outer threaded periphery (28), said grip (3) having an annular groove (31) defined in said inner periphery thereof, said shank (2) having a protrusion (32) extending radially outward therefrom so that said protrusion (32) is movably retained in said annular groove (31);

a ratchet (11) and a pawl (15) rotatably received in said head (1), said pawl (15) engaged with said rachet (11), and an actuating member (21) connected to a second end of said rod (20) and engaged with said ratchet (11) which is rotated by said actuating member (21).

2. The ratchet tool as claimed in claim 1, wherein said actuating member (21) is a tubular member and has teeth (22) defined in the distal end thereof, said teeth (22) engaged with said ratchet (11).

3. The ratchet tool as claimed in claim 1, wherein said ratchet (11) has an annular shoulder in which teeth (112) are defined, said actuating member (21) having teeth (22) defined in a periphery thereof and said teeth (22) engaged with said teeth (112) of said ratchet (11).

4. The ratchet tool as claimed in claim 1, wherein said second end of said rod (20) has an inner threaded periphery and said actuating member (21) is fixedly connected to the second end of said rod (20) by extending a bolt (23) through said actuating member (21) and engaged with said inner threaded periphery in the second end of said rod (20).

5. The ratchet tool as claimed in claim 1, wherein the first end of said rod (20) has a polygonal block (25) and said grip (3) has a polygonal recess (32) defined in an inner end thereof so that said polygonal block (25) is detachably received in said polygonal recess (32).

6. The ratchet tool as claimed in claim 5, wherein said grip (3) has an annular groove (31) defined in an inner periphery thereof, said shank (2) having a protrusion (32) extending radially outward therefrom so that said protrusion (32) is movably retained in said annular groove (31).

7. The ratchet tool as claimed in claim 5, wherein said grip (3) has a pin (36) movably extending radially inward from an inner periphery of said grip (3), said shank (2) having two notches (26) defined in an outer periphery thereof so that said pin (36) is inserted in one of said two notches (26).

8. The ratchet tool as claimed in claim 1, wherein the first end of said rod (20) has a tubular portion and a plurality of dents (29) are defined in the periphery of said tubular portion, said grip (3) having a recess (33) defined in an inner end thereof so as to receive said tubular portion of said rod (20), a ball (39) embedded in the periphery defining said recess (33) and engaged with one of said dents (29).

* * * * *